US008528895B2

(12) United States Patent
Hanamoto

(10) Patent No.: US 8,528,895 B2
(45) Date of Patent: Sep. 10, 2013

(54) SHEET FEEDER AND IMAGE FORMING APPARATUS WITH THE SAME

(75) Inventor: Katsuhiko Hanamoto, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/357,211

(22) Filed: Jan. 24, 2012

(65) Prior Publication Data

US 2012/0193869 A1 Aug. 2, 2012

(30) Foreign Application Priority Data

Jan. 28, 2011 (JP) ..... 2011-016264

(51) Int. Cl.
*B65H 3/06* (2006.01)

(52) U.S. Cl.
USPC ..... 271/117

(58) Field of Classification Search
USPC ..... 271/117, 118
See application file for complete search history.

(56) References Cited

U.S. PATENT DOCUMENTS

| | | | | |
|---|---|---|---|---|
| 6,547,235 | B2 * | 4/2003 | Higaki | 271/10.01 |
| 6,598,873 | B2 * | 7/2003 | Takisawa et al. | 271/246 |
| 6,991,227 | B2 * | 1/2006 | Kim | 271/10.12 |
| 7,320,462 | B2 * | 1/2008 | Takamatsu | 271/3.14 |
| 7,398,970 | B2 * | 7/2008 | Morimoto et al. | 271/117 |
| 7,506,867 | B2 * | 3/2009 | Lee et al. | 271/117 |
| 7,530,563 | B2 * | 5/2009 | Kuo | 271/124 |
| 7,571,905 | B2 * | 8/2009 | Kim | 271/117 |
| 7,717,415 | B2 * | 5/2010 | Kim et al. | 271/110 |
| 7,753,363 | B2 * | 7/2010 | Liu et al. | 271/121 |
| 8,052,137 | B2 * | 11/2011 | Chung et al. | 271/117 |
| 8,052,139 | B1 * | 11/2011 | Su et al. | 271/117 |
| 8,118,299 | B2 * | 2/2012 | Sato | 271/118 |
| 8,231,122 | B2 * | 7/2012 | Tu | 271/121 |
| 8,292,289 | B2 * | 10/2012 | Kotaka et al. | 271/117 |
| 8,313,097 | B2 * | 11/2012 | Kayama | 271/117 |
| 2005/0263955 | A1 | 12/2005 | Kim | |
| 2007/0001374 | A1 * | 1/2007 | Lee | 271/117 |
| 2012/0193863 | A1 * | 8/2012 | Harada | 271/110 |

FOREIGN PATENT DOCUMENTS

| | | |
|---|---|---|
| JP | 6-144624 | 5/1994 |
| JP | 2000-72269 | 3/2000 |
| JP | 2002-29639 | 1/2002 |

* cited by examiner

*Primary Examiner* — Kaitlin Joerger
*Assistant Examiner* — Ernesto Suarez
(74) *Attorney, Agent, or Firm* — Gerald E. Hespos; Michael J. Porco; Matthew T. Hespos

(57) ABSTRACT

A sheet feeder includes a stopper located in a sheet feeding route and supported rotatably about a pivot point. The posture of the stopper is changed among a restricting posture in which a contact end contacts a leading end SU of a sheet S in a feeding direction to restrict the leading end SU before a feeding of the sheet S by a feeding mechanism, a feed allowing posture assumed during feeding and in which the contact end is separated from the leading end SU in a first direction F in which the sheet S is fed, and a rotational posture reached by rotating the stopper about the pivot point so that the contact end faces in a second direction opposite the first direction. The second direction is a direction in which the sheet S is pulled out from the feeding mechanism when a jam occurs.

7 Claims, 9 Drawing Sheets

SHEET FEEDER AND IMAGE FORMING APPARATUS WITH THE SAME

This application is based on and claims the benefit of priority from Japanese Patent Application Ser. No. 2011-016264 filed with Japan Patent Office on Jan. 28, 2011, the contents of which are hereby incorporated by reference.

BACKGROUND

The present disclosure relates to a sheet feeder for feeding a sheet such as a document to a predetermined document reading position and an image forming apparatus with the same.

An image forming apparatus such as a copier includes a sheet feeder for conveying a document sheet such as a document with an image to a predetermined reading position, an image reader for reading a document image of a document sheet at the reading position to obtain image data, and an image forming unit for forming an image based on image data on a recording sheet.

The sheet feeder includes, as basic constituent elements, a pickup roller for feeding document sheets placed on a sheet tray one by one to a conveyance path, a feed roller for further feeding a document sheet picked up by the pickup roller to the conveyance path, a plurality of conveyor roller pairs for conveying a document sheet to a document reading position and a cover unit holding these members while allowing the rotation thereof.

Such a sheet feeder also includes a stopper. The stopper is a member arranged between the pickup roller and the feed roller and comes into contact with the leading end in a feeding direction of a document sheet placed on the sheet tray to restrict the position of the leading end in the feeding direction, i.e. align the position of the leading end in the feeding direction before a feeding operation by the pickup roller. By aligning the position of the leading end in the feeding direction, it is suppressed that the document sheet is fed in an oblique posture to the conveyance path at the time of the feeding operation by the pickup roller.

In a conventional sheet feeder using such a stopper, the stopper is coupled to a drive shaft of a pickup roller via a one-way clutch. When a document sheet is placed on a sheet tray and the leading end thereof in a feeding direction comes into contact with the stopper, a load of a drive system acts on the stopper via the one-way clutch, wherefore the stopper can specify the position of the leading end in the feeding direction. On the other hand, when the drive shaft of the pickup roller rotates, the load of the drive system acting on the stopper is released by the action of the one-way clutch and the stopper is pushed up (rotated) by a pressing force given by the document sheet being fed, thereby being separated from the leading end in the feeding direction. In this way, the document sheet is fed to the conveyance path.

In the above sheet feeder constructed as described above, when a jam occurs due to a feeding operation by the pickup roller or the feed roller, a user can remove the jammed document sheet by opening the cover unit and exposing the conveyance path to the outside. However, if the user does not know about the procedure of such a jam process, he tries to grab a part (e.g. trailing end in the feeding direction) of a jammed document sheet and forcibly pull out the jammed sheet from the conveyance path if the document sheet is jammed and the trailing end in feeding direction remains on the sheet tray. Thus, the stopper is likely to be caught by the document sheet being pulled out. If the stopper is caught by the document sheet, the document sheet may be torn.

Accordingly, in view of the above situation, an object of the present disclosure is to provide a sheet feeder capable of suppressing document sheet breakage even if a jammed document sheet is forcibly pulled out and an image forming apparatus with the same.

SUMMARY

To achieve this object, a sheet feeder as one aspect of the present disclosure has a feeding mechanism, a supporting body and a stopper member.

The feeding mechanism feeds a sheet (S) along a sheet feeding route. The stopper member (532) is located in the sheet feeding route and is supported on the supporting body (531) rotatably about a first rotational pivot point. The stopper member (532) includes a contact end portion (538); and the stopper member (532) changes its posture among (i) a restricting posture (FIG. 8) in which the contact end portion (538) comes into contact with a leading end of the sheet in a feeding direction to restrict the position of the leading end in the feeding direction before a feeding operation of feeding the sheet by the feeding mechanism; (ii) a feed allowing posture (FIG. 9) which is assumed during the feeding operation and in which the contact end portion (538) is separated from the position of the leading end of the sheet in the feeding direction in the restricting posture in a first direction (F) in which the sheet (S) is fed; and (iii) a rotational posture (FIG. 10) reached from the feed allowing posture (FIG. 9) by the rotation of the stopper piece (532) about the first rotational pivot point so that the contact end portion (538) faces in a second direction (R) opposite to the first direction (F).

The second direction (R) is a direction in which the sheet is pulled out from the feeding mechanism when a jam occurs in the feeding mechanism.

According to the sheet feeder of the present disclosure, the posture of the stopper member is changed among the restricting posture, the feed allowing posture and the rotational posture. The stopper member assumes the restricting posture to restrict the position of the leading end of the sheet in the feeding direction by the contact end portion before the feeding operation by the feeding mechanism. Further, since the stopper member assumes the feed allowing posture, in which the contact end portion is separated from the leading end in the feeding direction, during the feeding operation, it does not interfere with the feeding operation.

Further, when a jam occurs in the feeding mechanism, the stopper member rotates about the first rotational pivot point from the feed allowing posture to assume the rotational posture so that the contact end portion faces in the second direction in which the sheet is pulled out. This suppresses that the sheet is caught by the stopper member. As a result, a pressure received by the stopper member from the sheet being pulled out is reduced and breakage of the document sheet is suppressed.

These and other objects, features and advantages of the sheet feeder of the disclosure will become apparent upon reading the following detailed description along with the accompanied drawings.

DETAILED DESCRIPTION

Figure 1:
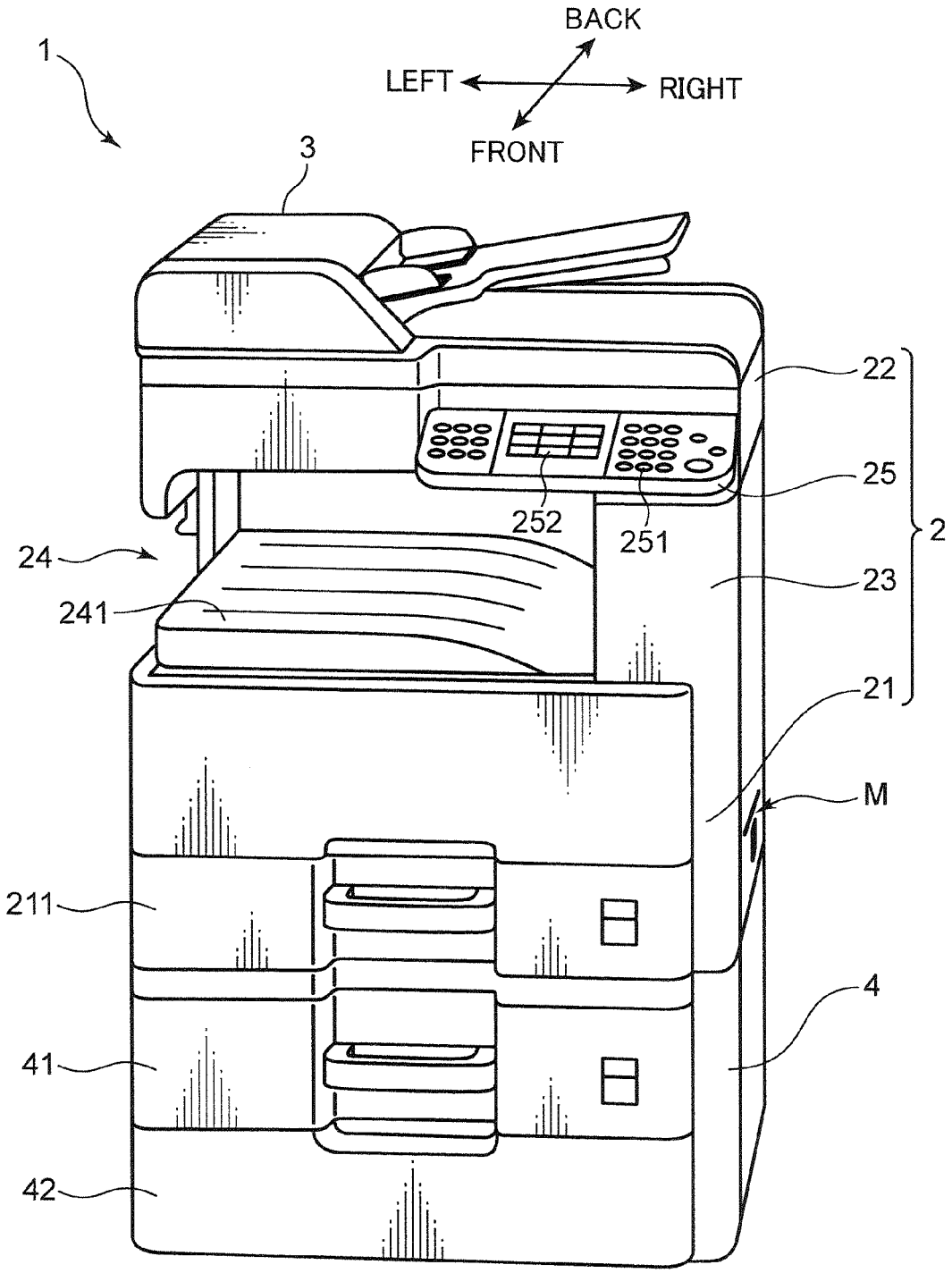
FIG. 1 is a perspective view showing the external appearance of an image forming apparatus according to one embodiment of the present disclosure.
Figure 2:
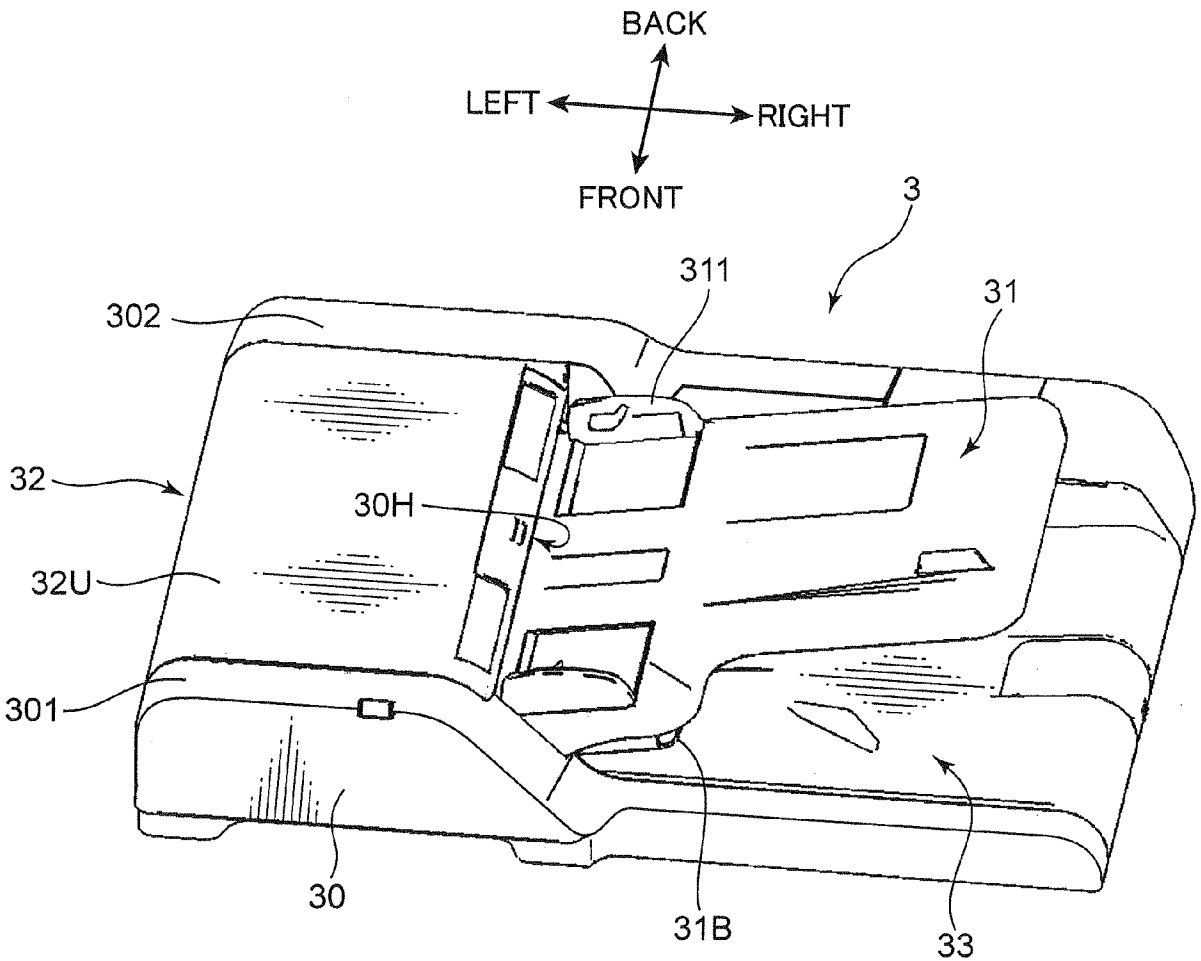
FIG. 2 is a perspective view showing the external appearance of an automatic document feeder.
Figure 3:
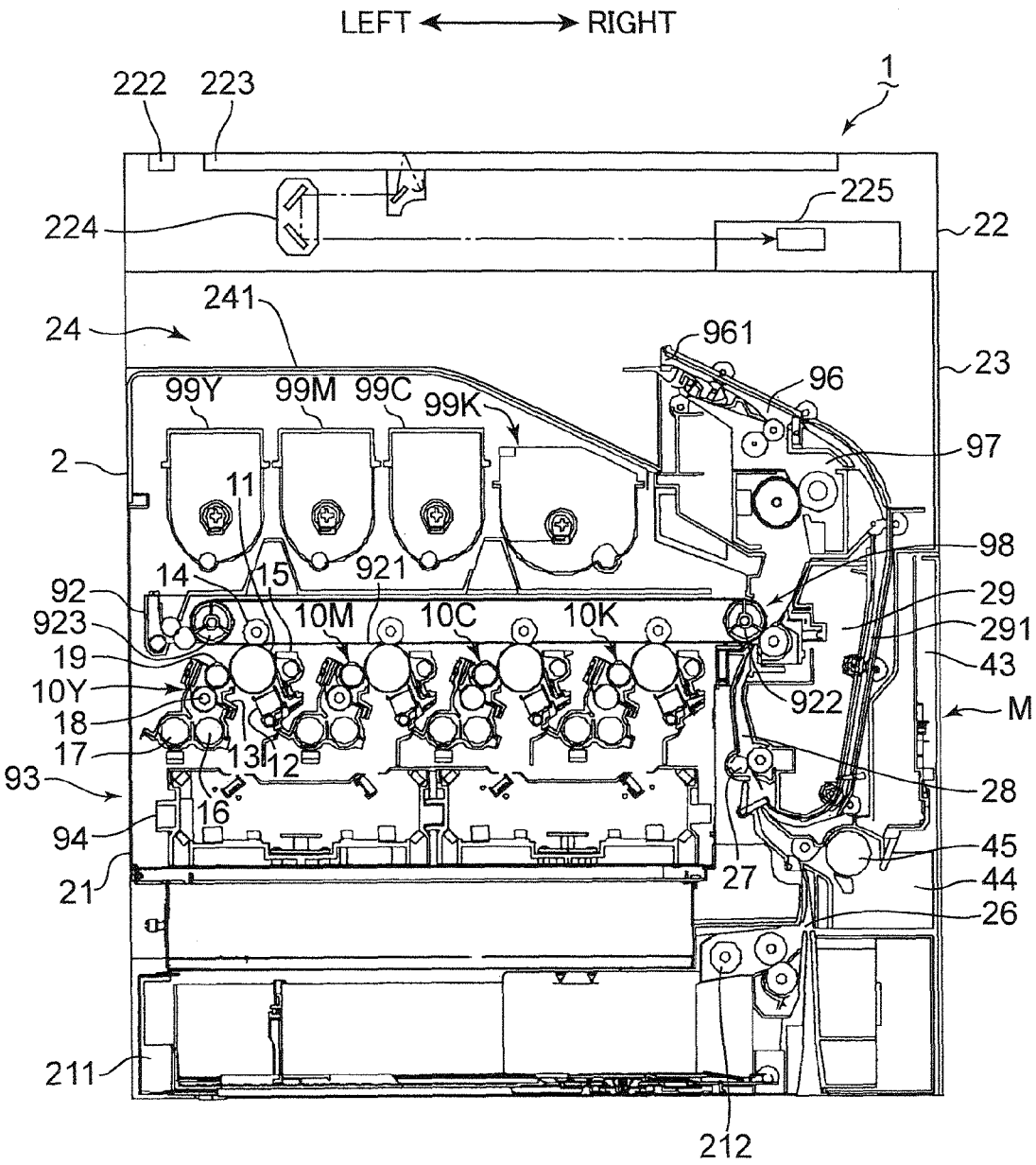
FIG. 3 is a sectional view showing the internal structure of the image forming apparatus.

Hereinafter, an embodiment of the present disclosure is described in detail with reference to the drawings. FIG. 1 is a perspective view showing the external appearance of an image forming apparatus 1 according to one embodiment of the present disclosure, FIG. 2 is a perspective view showing the external appearance of an automatic document feeder 3, and FIG. 3 is a sectional view showing the internal structure of the image forming apparatus 1. Although a copier of an internal discharge type is illustrated as the image forming apparatus 1 here, the image forming apparatus may be a printer, a facsimile machine, or a complex machine provided with these functions.

The image forming apparatus 1 includes an apparatus main body 2 having a substantially rectangular parallelepipedic housing structure and including an internal space (internal discharging portion 24), the automatic document feeder 3 (sheet feeder) arranged on the upper surface of the apparatus main body 2 and an extension sheet feeder unit 4 assembled at a lower side of the apparatus main body 2.

The apparatus main body 2 performs an image forming process on a sheet. The apparatus main body 2 includes a substantially rectangular parallelepipedic lower housing 21, a substantially rectangular parallelepipedic upper housing 22 arranged above the lower housing 21, and a coupling housing 23 coupling the lower housing 21 and the upper housing 22. Various devices for image formation are housed in the lower housing 21, and various devices for optically reading a document image are housed in the upper housing 22. An internal space enclosed by the lower housing 21, the upper housing 22 and the coupling housing 23 serves as an internal discharge portion 24 capable of storing a sheet after image formation. The coupling housing 23 is arranged at a side of the right surface of the apparatus main body 2 and provided with a discharge opening 961 for discharging a sheet to the internal discharge portion 24.

The internal space utilized as the internal discharge portion 24 is exposed to the outside at the front surface and the left surface of the apparatus main body 2. A user can take out a sheet after image formation from the internal discharge portion 24 by inserting his hand through these exposed parts. A bottom surface 241 of the internal space is defined by the upper surface of the lower housing 21, and sheets discharged from the discharge opening 961 are stacked thereon.

An operation panel unit 25 is provided to project from the front surface of the upper housing 22. The operation panel unit 25 is provided with operation keys 251 including a numerical keypad and a start key, an LCD touch panel 252, etc. and receives input of various operation instructions from the user. The user can input the number of sheets to be printed, print density, etc. by means of the operation panel unit 25.

A sheet cassette 211 for storing recording sheets on which an image forming process is to be performed is mounted in the lower housing 21. The extension sheet feeder unit 4 also includes sheet cassettes 41, 42 for storing recording sheets on which the image forming process is to be performed. These sheet cassettes 211, 41 and 42 are provided for automatic sheet feeding and a large number of recording sheets can be stored according to sizes. Further, the sheet cassettes 211, 41 and 42 can be withdrawn forward from the front surface of the lower housing 21 or the extension sheet feeder unit 4. Note that only the sheet cassette 211 of the lower housing 21 is drawn in FIG. 3.

A multi-tray unit M enabling the user to manually feed a sheet is mounted on the right surface of the apparatus main body 2. The multi-tray unit M includes a feed tray 43, on which a recording sheet to be manually fed is to be placed, and a feeding unit 44 for feeding the recording sheet to an image forming station in the lower housing 21. The feed tray 43 is openably and closably mounted on the lower housing 21 at a lower end portion thereof and is in a closed state when not used. The user opens the feed tray 43 and places a recording sheet thereon in the case of manually feeding the sheet.

The automatic document feeder 3 is rotatably mounted on the rear side of the upper surface of the apparatus main body 2. Note that this automatic document feeder 3 is not shown in FIG. 3. The automatic document feeder 3 automatically feeds a document sheet to be copied toward a predetermined document reading position (position where a first contact glass 222 is mounted) in the apparatus main body 2. On the other hand, when the user manually places a document sheet on a predetermined document reading position (arrangement position of a second contact glass 223), the automatic document feeder 3 is opened upward.

With reference to FIG. 2, the automatic document feeder 3 includes a main housing 30, a document feed tray 31, a document conveying unit 32, a document discharge tray 33 and a document reversing tray 31B. The main housing 30 is a housing for housing various mechanisms provided in the automatic document feeder 3 and includes a front wall portion 301 and a rear wall portion 302 raised upward at the left side where the document conveying unit 32 is housed and a substantially flat low-level part on the right side.

The document feed tray 31 is a tray on which a document sheet to be fed to the image reading position is to be placed, and attached to the main housing 30 in such a manner as to extend from a feed opening 30H of the main housing 30. The document feed tray includes a pair of cursors 311 for aligning the width of a placed document sheet.

The document conveying unit 32 includes a conveyance path and a conveying mechanism for conveying a document sheet on the document feed tray 31 to the document discharge tray 33 via the image reading position. The document conveying unit 32 includes an upper cover unit 32U fitted in an opening between the front wall portion 301 and the rear wall portion 302 of the main housing 30. The cover unit 32U is openable and closable relative to the main housing 30. These are described in detail later based on FIG. 4, etc.

The document discharge tray 33 is a tray to which a document sheet is discharged after a document image thereof is optically read. The upper surface of the low-level part on the right side of the main housing 30 serves as the document discharge tray 33. The document reversing tray 31B is a tray to which a document sheet is temporarily discharged in reading the document sheet including document images on both sides.

Next, the internal construction of the apparatus main body 2 is described based on FIG. 3. Toner containers 99Y, 99M, 99C and 99K, an intermediate transfer unit 92, an image forming station 93, an exposure unit 94 and the above sheet cassette 211 are housed in this order from top in the lower housing 21.

The image forming station 93 includes four image forming units 10Y, 10M, 10C and 10K for forming toner images of yellow (Y), magenta (M), cyan (C) and black (K) to form a full-color toner image. Each of the image forming units 10Y, 10M, 10C and 10K includes a photosensitive drum 11, and a charger 12, a developing device 13, a primary transfer roller 14 and a cleaner 15 arranged around the photosensitive drum 11.

The photosensitive drum 11 rotates about its shaft and has an electrostatic latent image and a toner image formed on its circumference surface. A photosensitive drum using an amorphous silicon (a-Si) containing material can be used as the photosensitive drum 11. The charger 12 uniformly charges the circumferential surface of the photosensitive drum 11. The circumferential surface of the photosensitive drum 11 after charging is exposed to light by the exposure unit 94 to form an electrostatic latent image.

The developing device 13 supplies toner to the circumferential surface of the photosensitive drum 11 to develop an electrostatic latent image formed on the photosensitive drum 11. The developing device 13 is for a two-component developer and includes agitating rollers 16, 17, a magnetic roller 18 and a developing roller 19. The agitating rollers 16, 17 charge the toner by conveying the two-component developer in a circulating manner while agitating it. The two-component developer is carried on the circumferential surface of the magnetic roller 18, and the toner is transferred to the circumferential surface of the developing roller 19 due to a potential difference between the magnetic roller 18 and the developing roller 19, whereby a toner layer is formed and carried on the circumferential surface of the developing roller 19. The toner on the developing roller 19 is supplied to the circumferential surface of the photosensitive drum 11, thereby developing the electrostatic latent image.

The primary transfer roller 14 forms a nip portion together with the photosensitive drum 11 with an intermediate transfer belt 921 of the intermediate transfer unit 92 sandwiched therebetween, and primarily transfers the toner image on the photosensitive drum 11 to the intermediate transfer belt 921. The cleaner 15 cleans the circumferential surface of the photosensitive drum 11 after the transfer of the toner image.

The yellow toner container 99Y, the magenta toner container 99M, the cyan toner container 99C and the black toner container 99K are respectively for storing toners of the respective colors, and supply the toners of the respective colors to the developing devices 13 of the image forming units 10Y, 10M, 10C and 10K corresponding to the respective YMCK colors via unillustrated supply paths.

The exposure unit 94 includes a light source and various optical components such as a polygon mirror, a reflecting mirror and a deflecting mirror, and irradiates the circumferential surfaces of the photosensitive drums 11 provided in the respective image forming units 10Y, 10M, 10C and 10K with beams based on image data of a document image to form electrostatic latent images.

The intermediate transfer unit 92 includes the intermediate transfer belt 921, a drive roller 922 and a driven roller 923. Toner images from a plurality of photosensitive drums 11 are superimposed on the intermediate transfer belt 921 (primary transfer). The superimposed toner images are secondarily transferred to a recording sheet supplied from the sheet cassette 211 in a secondary transfer unit 98. The drive roller 922 and the driven roller 923 for rotationally driving the intermediate transfer belt 921 are rotatably supported on the lower housing 21.

The sheet cassette 221 (41, 42) stores a sheet stack composed of a plurality of recording sheets stacked one over another. A pickup roller 212 is arranged above the right end of the sheet cassette 211. By driving the pickup roller 212, the uppermost recording sheet of the sheet stack in the sheet cassette 211 is picked up one by one and conveyed to a carry-in conveyance path 26. On the other hand, a recording sheet manually placed on the feed tray 43 is conveyed to the carry-in conveyance path 26 by driving a feed roller 45 of the feeding unit 44.

A sheet conveyance path 28 extending up to the discharge opening 961 via the secondary transfer unit 98, a fixing unit 97 and a discharge unit 96 to be described later is provided downstream of the carry-in conveyance path 26. An upstream part of the sheet conveyance path 28 is formed between an inner wall formed in the lower housing 21 and an inner wall forming the inner side surface of a reversing unit 29. Note that an outer side surface of the reversing unit 29 constitutes one surface of a reversing conveyance path 291 for reversing and conveying a sheet at the time of duplex printing. A pair of registration rollers 27 are arranged at a position of the sheet conveyance path 28 upstream of the secondary transfer unit 98. The sheet is temporarily stopped by the pair of registration rollers 27 and fed to the secondary transfer unit 98 at a predetermined timing for image transfer after a skew correction.

The fixing unit 97 and the discharge unit 96 are housed in the coupling housing 23. The fixing unit 97 includes a fixing roller and a pressure roller and performs a fixing process by heating and pressing a recording sheet having a toner image secondarily transferred in the secondary transfer unit 98. The recording sheet with the fixed color image is discharged from the discharge opening 961 toward the internal discharge portion 24 by the discharge unit 96 arranged downstream of the fixing unit 97.

The first contact glass 222 and the second contact glass 223 are embedded in the upper surface of the upper housing 22. The first contact glass 222 is provided for reading a document sheet automatically fed by the automatic document feeder 3. The second contact glass 223 is provided for reading a manually placed document sheet.

A scanning mechanism 224 and an image pickup device 225 for optically reading document information of a document sheet are housed in the upper housing 22. The scanning mechanism 224 includes a light source, a moving carriage, a reflecting mirror, etc. and introduces reflected light from a document to the image pickup device 225. The image pickup device 225 photoelectrically converts the reflected light into an analog electrical signal. The analog electrical signal is input to the exposure unit 94 after being converted into a digital electrical signal in an A/D conversion circuit (not shown).

Figure 4:
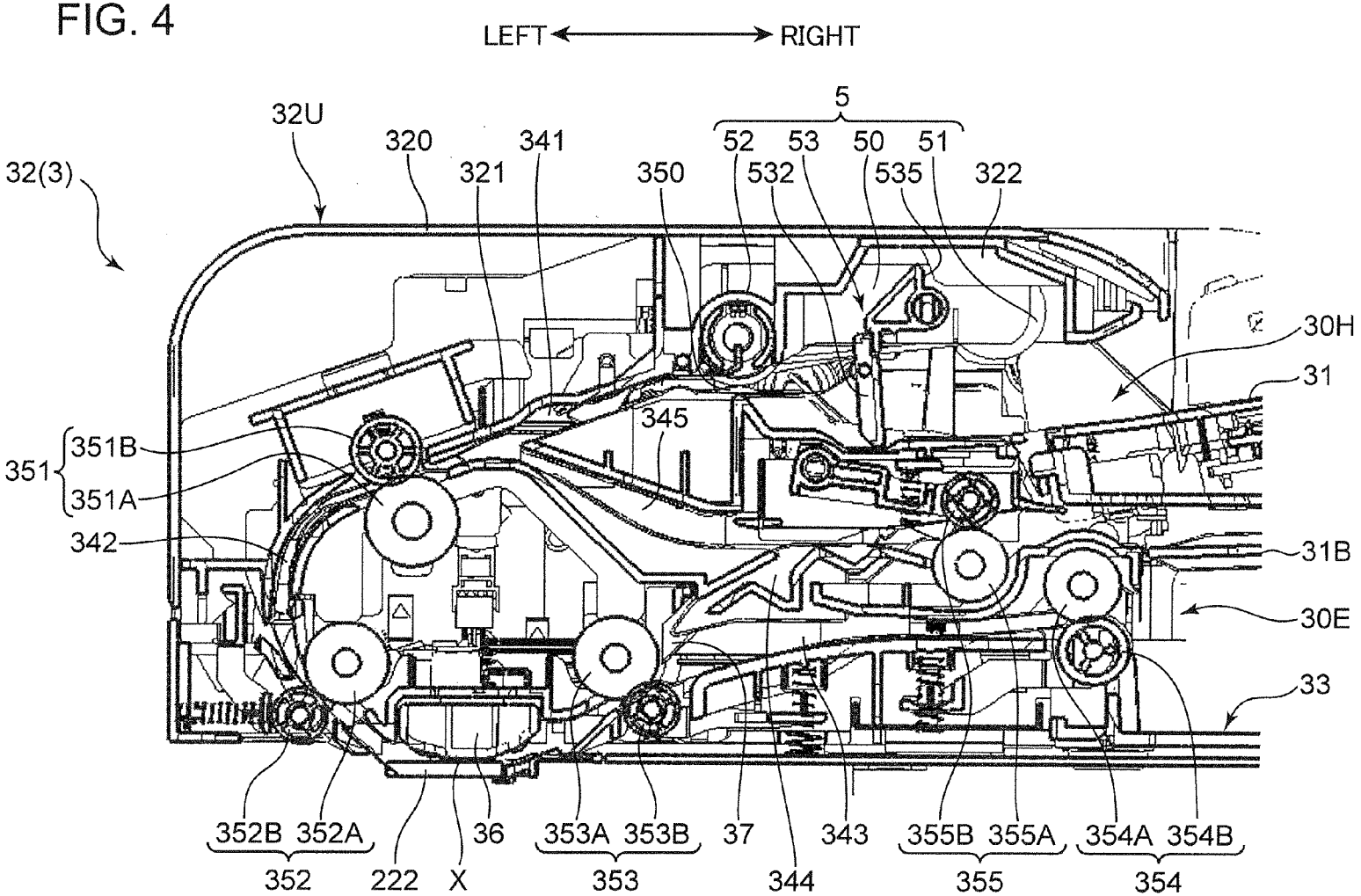
FIG. 4 is a sectional view of an essential part of the automatic document feeder.
Figure 5:
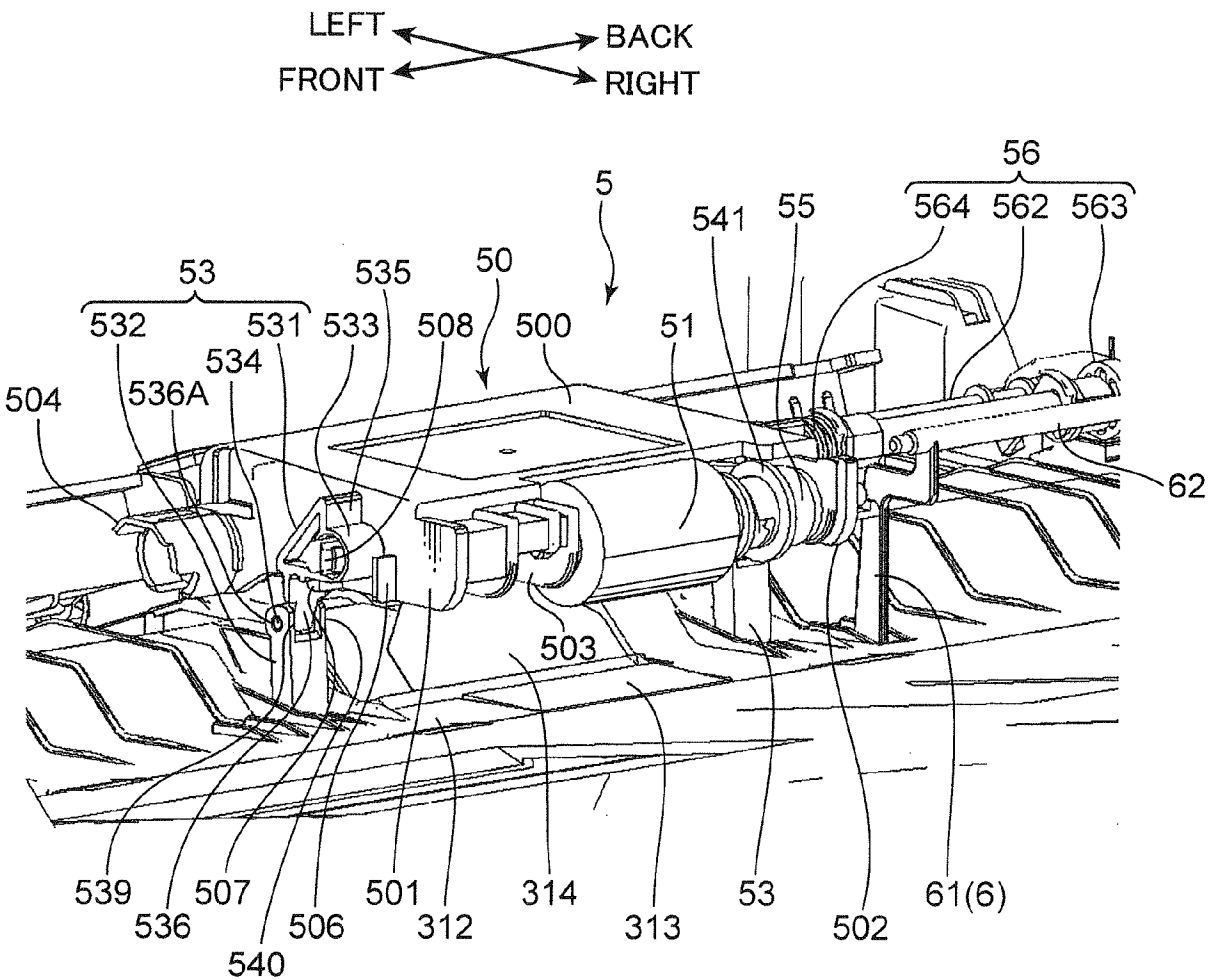
FIG. 5 is a perspective view enlargedly showing a part of a document feeder unit of the automatic document feeder.
Figure 6:
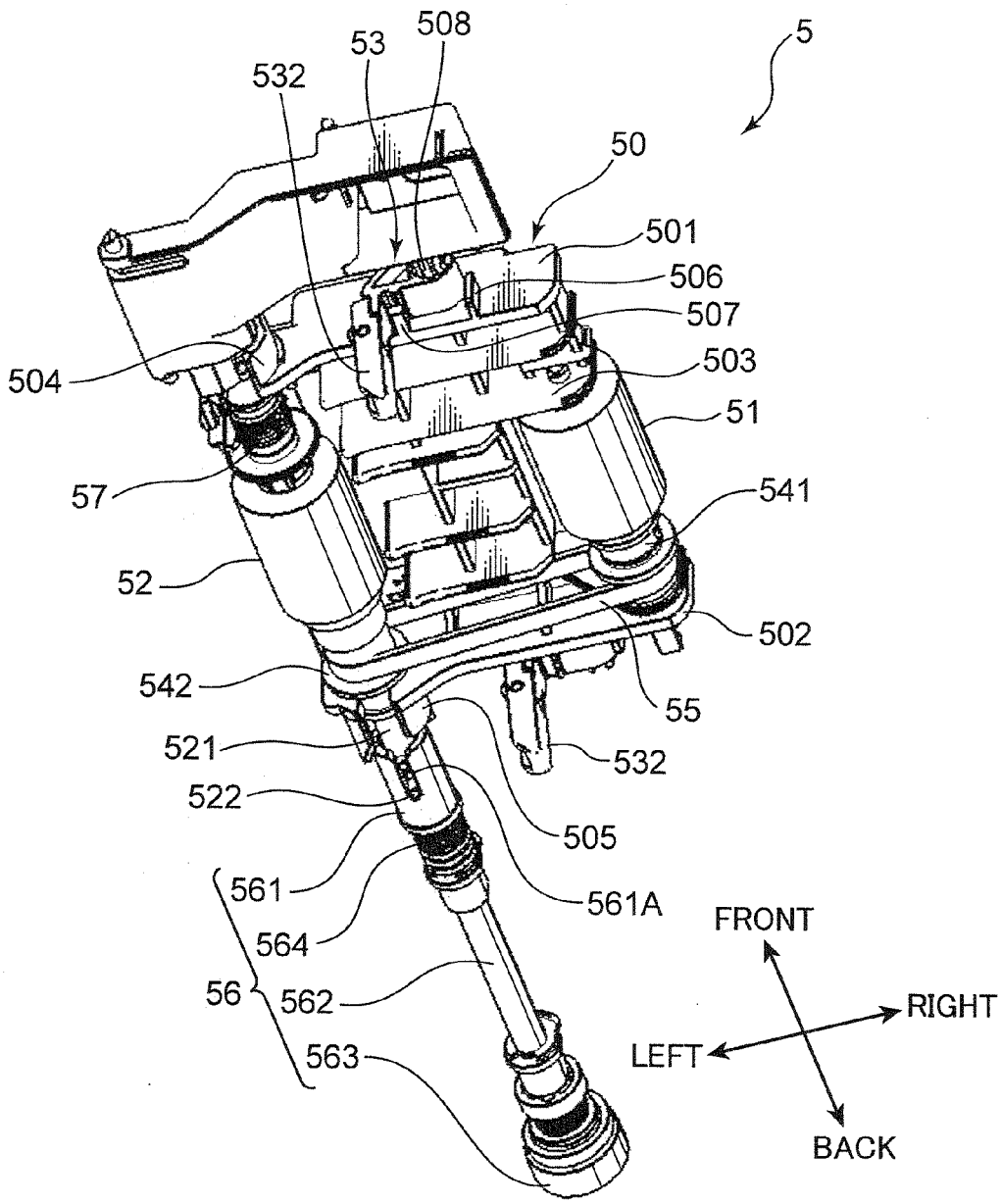
FIG. 6 is a perspective view of the document feeder unit when viewed from below.
Figure 7:
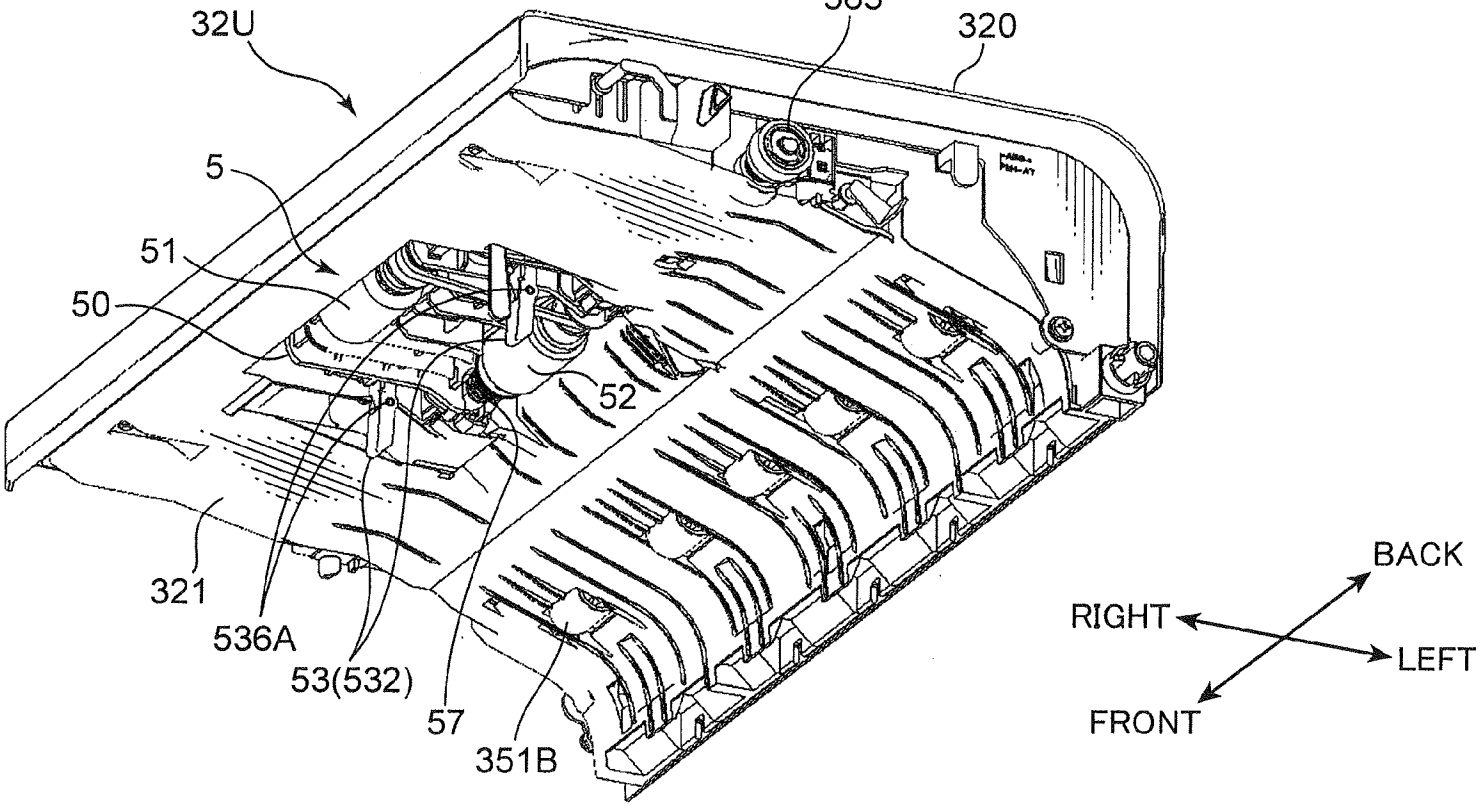
FIG. 7 is a perspective view of an upper cover unit of the automatic document feeder when viewed from below.

Next, the internal structure of the automatic document feeder 3 is described in detail based on FIGS. 4 to 7. FIG. 4 is a sectional view showing an essential part (document conveying unit 32) of the automatic document feeder 3. The document conveying unit 32 includes first to fifth conveyance paths 341 to 345 constituting a conveyance route for document sheets, first to fifth conveyor roller pairs 351 to 355 arranged at suitable positions of these first to fifth conveyance paths 341 to 345, and a document feeder unit 5 for feeding a document sheet placed on the document feed tray 31 into the document conveying unit 32. FIG. 5 is a perspective view enlargedly showing the document feeder unit 5, FIG. 6 is a perspective view of the document feeder unit 5 when viewed from below and FIG. 7 is a perspective view of the upper cover unit 32U described above when viewed from below.

The first, second and third conveyance paths 341, 342 and 343 constitute a U-shaped conveyance path extending from the above feed opening 30H to a discharge opening 30E, through which a document sheet is discharged to the document discharge tray 33, via a reading position X where a document image is optically read. On the other hand, the fourth and fifth conveyance paths 344, 345 are switchback conveyance paths used to reverse a document sheet in reading the document sheet having document images on both sides.

The first conveyance path 341 is a conveyance path which is continuous with the document feed tray 31 and extends leftward and slightly downward from the feed opening 30 H and in which a document sheet fed from the document feeder unit 5 first passes. An upper conveying surface of this first conveyance path 341 is defined by a guide member 321 (see FIG. 7) of the upper cover unit 32U. The second conveyance path 342 is an arcuate conveyance path extending from the downstream end of the first conveyance path 341 to the document reading position X facing the first contact glass 222. One conveying surface of this second conveyance path 342 is also defined by the guide member 321 of the upper cover unit 32U. The third conveyance path 343 is a conveyance path extending rightward and slightly upward from the position facing the first contact glass 222 to the discharge opening 30E. Note that a contact guide 36 to bring a document sheet into sliding contact with the first contact glass 222 is arranged at the position facing the first contact glass 222.

The fourth conveyance path 344 is a conveyance path branched off from the third conveyance path 343 and extending upward and rightward. A switching lever 37 is arranged at a position where the third and fourth conveyance paths 343, 344 are branched. The switching lever 37 guides a document sheet to the third conveyance path 343 in the case of normal one-side reading while guiding a document sheet to the fourth conveyance path 344 when the document sheet having one side read needs to be reversed upside down in the case of reading both sides of the document sheet. The fifth conveyance path 345 is a substantially horizontal conveyance path communicating with the fourth conveyance path 344, the first conveyance path 341 and the document reversing tray 31B and used to receive the document sheet to be reversed upside down from the fourth conveyance path 344 and switch back and convey it to the first conveyance path 341.

Each of the first, second, third, fourth and fifth conveyor roller pairs 351, 352, 353, 354 and 355 is composed of a combination of a drive roller 351A, 352A, 353A, 354A or 355A for generating a rotational driving force for conveying the document sheet and a driven roller 351B, 352B, 353B, 354B or 355B held in contact with the drive roller to be driven and rotated.

The first conveyor roller pair 351 is arranged between the first and second conveyance paths 341, 342 and feeds a document sheet toward the largely curved second conveyance path 342. The second conveyor roller pair 352 is arranged right upstream of the document reading position X and feeds the document sheet to this document reading position X. The third conveyor roller pair 353 is arranged right downstream of the document reading position X and feeds the document sheet after image reading to the third or fourth conveyance path 343 or 344. The fourth conveyor roller pair 354 is arranged near the discharge opening 30E and discharges the document sheet toward the document discharge tray 33. The fifth conveyor roller pair 355 is composed of a pair of rollers which can rotate in forward and reverse directions, arranged in the fifth conveyance path 345, and switches back and conveys the document sheet utilizing the document reversing tray 31B.

The document feeder unit 5 includes a pickup roller 51 (roller member), a document feed roller 52 arranged downstream of the pickup roller 51 in a sheet conveying direction, stopper mechanisms 53 for restricting a document sheet placed on the document feed tray 31, a holder 50 for holding these members, a driving mechanism 56 (pivoting unit) for pivoting the holder 50, and a torsion coil spring 57 for applying a torque to the holder 50. As shown in FIG. 7, the document feeder unit 5 is mounted in the upper cover unit 32U. The automatic document feeder 3 further includes an unillustrated motor for applying a rotational driving force in a forward or reverse direction to the driving mechanism 56.

As shown in FIGS. 5 and 6, the holder 50 is a box-shaped member including an upper plate 500 in the form of a flat plate, a front plate 501, a rear plate 502 and a middle plate 503 made of rib members integral to the upper plate 500. A front tubular portion 504 and a rear tubular portion 505, which are coaxially arranged, project from the front plate 501 and the rear plate 502. The holder 50 pivots about tube centers of the front and rear tubular portions 504, 505.

The pickup roller 51 has a torque applied thereto to rotate about its axis and feeds document sheets placed on the document feed tray 31 one by one to the document conveying unit 32 (first conveyance path 341). A rotary shaft of the pickup roller is rotatably supported at the right sides of the rear and middle plates 502, 503. The pickup roller 51 shifts its position between a feeding position where it is in contact with the upper surface of the document sheet on the document feed tray 31 and a retracted position where it is spaced upward from the upper surface of the document sheet by a pivotal movement of the holder 50 about the tube centers of the front and rear tubular portions 504, 505.

As shown in FIG. 5, a separation pad 313 is arranged at a position facing the pickup roller 51 at a downstream end 312 of the document feed tray 31. When the pickup roller 51 is at the feeding position, a nip portion is formed between the pickup roller 51 and the separation pad 313.

The document feed roller 52 conveys one document sheet fed from the pickup roller 51 further to the first conveyance path 341. The rotary shaft 521 of the document feed roller 52 is rotatably supported by the front and rear plates 501, 502 of the holder 50. In feeding a document sheet, a rotational driving force is applied to the rotary shaft 521 and the document feed roller 52 rotates. Note that, as shown in FIG. 4, a driven roller 350 is arranged to face this document feed roller 52 in the main housing. The front and rear tubular portions 504, 505 of the holder 50 described above are mounted rotatably about the axis of this rotary shaft 521. That is, the axial center of the rotary shaft 521 and the tube centers of the front and rear tubular portions 504, 505 are coaxial, wherefore the document feed roller is not vertically moved even if the holder 50 pivots, and constantly forms the sheet feeding nip portion together with the driven roller 350.

The stopper mechanisms 53 are located between the pickup roller 51 and the document feed roller 52 in a lateral direction. The stopper mechanisms 53 are for aligning the leading end of a document sheet in a feeding direction by restricting the leading end in the feeding direction before the pickup roller 51 starts a feeding operation. By aligning the leading end in the feeding direction, it is suppressed that the document sheet is fed in an oblique posture to the first conveyance path 341. The construction of the stopper mechanisms 53 is described in detail later.

A first wheel 541 having a multitude of grooves formed in the outer circumferential surface is fixed to the rotary shaft of the pickup roller 51. Further, a second wheel 542 including similar grooves is fixed to the rotary shaft 521 of the document feed roller 52 (see FIG. 6). These first and second wheels 541, 542 are respectively arranged at positions behind the pickup roller 51 and the document feed roller 52. An endless belt 55 (transmission mechanism) for power transmission is mounted between the first and second wheels 541, 542. A multitude of projections engageable with the grooves of the first and second wheels 541, 542 are formed on the inner circumferential surface of the endless belt 55. When a rotational driving force in a direction to feed the document sheet (rotational driving force in a forward direction; rotational driving force in a clockwise direction when viewed from front) is applied to the rotary shaft 521 of the document feed roller 52, this rotational driving force is transmitted to the rotary shaft of the pickup roller 51 via the endless belt 55. As a result, the pickup roller 51 and the document feed roller 52 are both rotated in synchronization.

The driving mechanism 56 is a mechanism for transmitting the rotational driving force of the motor in the forward or reverse direction to the rotary shaft 521 of the document feed roller 52. The driving mechanism 56 includes a coupling portion 561, a shaft 562, a drive input portion 563 and a pressure spring 564.

The coupling portion 561 is a part to be engaged with the rotary shaft 521 and has a tubular shape for receiving the rotary shaft 521. A groove portion 561A extending in an axial direction of the rotary shaft 521 is formed in the tubular wall of the coupling portion 561. On the other hand, a pin 522 projects from the peripheral wall of the rotary shaft 521, and the above engagement is achieved by fitting this pin 522 into the groove portion 561A. The pressure spring 564 biases the coupling portion 561 forward to make the engagement of the groove portion 561A with the pin 522 reliable.

A rotational driving force is applied to the drive input portion 563 from the motor via an unillustrated gear mechanism. The coupling portion 561, the shaft 562 and the drive input portion 563 are united, so that the coupling portion 561 rotates when the drive input portion 563 is rotated and a rotational driving force thereof is transmitted to the rotary shaft 521. This causes the pickup roller 51 and the document feed roller 52 to rotate.

Since the front and rear tubular portions 504, 505 of the holder 50 is mounted on the rotary shaft 50 as described above, the holder 50 can rotate about the axial center of the rotary shaft 521. Thus, when a rotational driving force in the forward direction is applied to the rotary shaft 521, a moment in the clockwise direction acts on the holder 50. As a result, the holder 50 rotates about the axial center of the rotary shaft 521 in the clockwise direction and the pickup roller 51 moves to the feeding position to come into contact with the upper surface of a document sheet placed on the document feed tray 31. On the contrary, when a rotational driving force in the reverse direction (rotational driving force in a counterclockwise direction when viewed from front) is applied to the rotary shaft 521, a moment in the counterclockwise direction acts on the holder 50. As a result, the holder 50 moves to the retracted position to be spaced upward from the upper surface of the document sheet. Note that FIGS. 4 and 5 show a state where the pickup roller 51 is at the retracted position.

A coiled part of the torsion coil spring 57 is mounted on the rotary shaft 521, and the torsion coil spring 57 biases the holder 50 to maintain the pickup roller 51 at the retracted position. A biasing force of the torsion coil spring 57 is set to be smaller than a moment in the clockwise direction acting on the holder 50 when a rotational driving force in the forward direction is applied to the rotary shaft 521. Accordingly, when the rotary shaft 521 rotates in the forward direction when a document sheet is fed, the holder 50 rotates in the clockwise direction about the axial center of the rotary shaft 521 against the biasing force of the torsion coil spring 57. On the other hand, when a rotational driving force in the reverse direction is applied to the rotary shaft 521 and the pickup roller 51 moves to the retracted position, the posture of the holder 50 at that time is maintained by the biasing force of the torsion coil spring 57. At the retracted position, the holder 50 rests on a ceiling plate 320 of the upper cover unit 32U.

Figure 8:
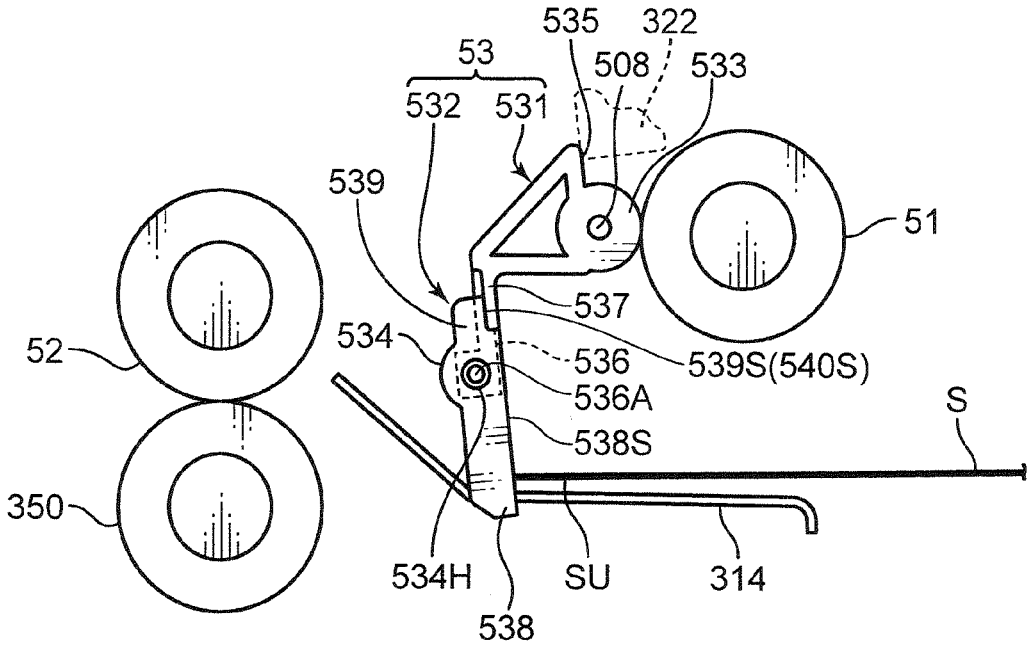
FIG. 8 is a side view diagrammatically showing a stopper mechanism in a state where a stopper member (stopper piece) of the stopper mechanism is in a restricting posture.

Next, the stopper mechanism 53 is described with reference to FIG. 8 as well as FIGS. 4 and 5. FIG. 8 is a side view diagrammatically showing the stopper mechanism 53 in a state where the stopper mechanism 53 (stopper piece) is in a restricting posture to be described later. The stopper mechanisms 53 are respectively mounted on the outer surfaces of the front and rear plates 501, 502 of the holder 50 to be located between the pickup roller 51 and the document feed roller 52. Since the respective stopper mechanisms 53 have the same construction, the stopper mechanism 53 mounted on the front plate 501 is described here.

The stopper mechanism 53 includes a supporting body 531 and a stopper piece 532. The supporting body 531 is set to have a substantially triangular shape in a front view, and one side thereof includes a semicylindrical rotational pivot portion (hereinafter, referred to as a second rotational pivot portion 533) projecting rightward. The second rotational pivot portion 533 includes a rotational pivot point (second rotation pivot point) of the supporting body 531. A shaft portion 508 projects from the front plate 501 of the holder 50. The shaft portion 508 is located between the pickup roller 51 and the document feed roller 52 when viewed from front. The supporting body 531 is rotatable about the second rotation pivot point by being supported on the shaft portion 508 via the second rotational pivot portion 533. A part of the one side of the supporting body 531 above the second rotational pivot portion 533 serves as a contact portion 535.

The supporting body 531 further includes a hanging piece 536 substantially perpendicularly hanging down from the bottom side. The hanging piece 536 has a pair of front and rear surfaces facing in forward and backward directions, wherein a rotation support shaft 536A projecting forward is formed on the front surface and a rotation support shaft 536A (see FIG. 7) projecting backward is also formed on the rear surface.

A rotation preventing piece 537 is integrally formed to the hanging piece 536. The rotation preventing piece 537 has front and rear surfaces facing in forward and backward directions. The rotation preventing piece 537 is set to be wider than the hanging piece 536 when viewed from right or left. The position of the rotation preventing piece 537 is set to be above the rotation support shaft 536A of the hanging piece 536. Although described later, the rotation preventing piece 537 comes into contact with the stopper piece 532 to prevent the clockwise rotation of the stopper piece 532 when viewed from front.

The stopper piece 532 is a long and narrow member arranged in the sheet conveyance route. The sheet conveyance route is a route along which a document sheet is conveyed successively by the pickup roller 51, the document feed roller 52 and the first to third conveyor roller pairs 351 to 353 as is clear from the description given using FIG. 4. The stopper piece 532 includes a rotation pivot portion (hereinafter, referred to as a first rotation pivot portion 534) and a contact end portion 538. Note that since it is not necessary to limit the stopper piece 532 to a long and narrow member in carrying out the present disclosure, the stopper piece 532 is called a "stopper member" in claims of the present application, which means that the shape of the stopper piece 532 is not limited to a long and narrow shape.

The first rotation pivot portion 534 includes a rotation pivot point (first rotation pivot point) of the stopper piece 532. The first rotation pivot portion 534 is set at a position of the stopper piece 532 near one end portion and includes a pair of front and rear walls 539, 540 (see FIG. 5) spaced apart in forward and backward directions. A distance between the front and rear walls 539, 540 is set to be larger than a distance between the front and rear surfaces of the hanging piece 536, and the hanging piece 536 is accommodated in a space between the front and rear walls 539, 540. The front and rear walls 539, 540 are respectively formed with coaxial through holes 534H, and a pair of rotation support shafts 536A of the hanging piece 536 are inserted into the corresponding through holes 534H. In this way, the stopper piece 532 is free to rotate about the first rotation pivot point relative to the supporting body 531.

Further, the distance between the front and rear walls 539, 540 is set to be smaller than a distance between the front and rear surfaces of the rotation preventing piece 537 so that the rotation preventing piece 537 cannot be accommodated in the space between the front and rear walls 539, 540. Thus, rightward facing surfaces of the respective front and rear walls 539, 540 serve as contact-stop surfaces 539A, 540S to be brought into contact with the rotation preventing piece 537. When it is attempted to rotate the stopper piece 532 clockwise when viewed from front, the contact-stop surface 539S is stopped by the contact with the rotation preventing piece 537. In this way, the clockwise rotation of the stopper piece 532 is restricted.

As just described, the stopper piece 532 is allowed to rotate counterclockwise when viewed from front, whereas the clockwise rotation thereof is restricted by the rotation preventing piece 537.

The other end portion of the stopper piece 532 serves as the contact end portion 538. This contact end portion 538 comes into contact with the leading end in the feeding direction of a document sheet placed on the document feed tray 31 to restrict the position of the leading end in the feeding direction before the pickup roller 51 starts the feeing operation of feeding the document sheet. The contact end portion 538 includes a restricting surface 538S which comes into contact with the leading end in the feeding direction.

Figure 9:
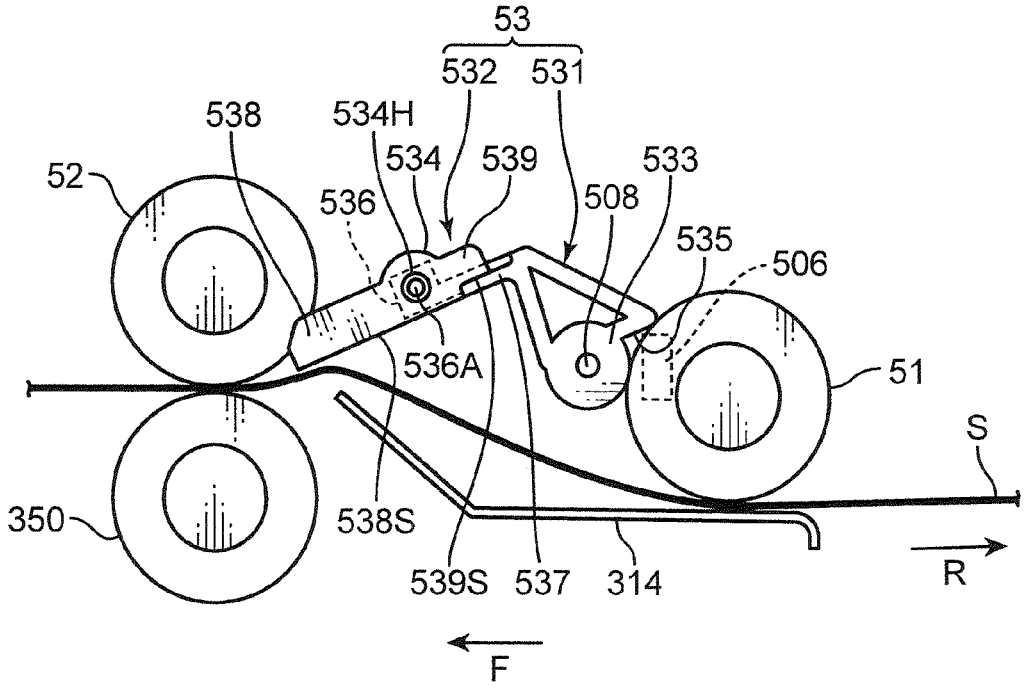
FIG. 9 is a diagram showing a state where the stopper member (stopper piece) is in a feed allowing posture.
Figure 10:
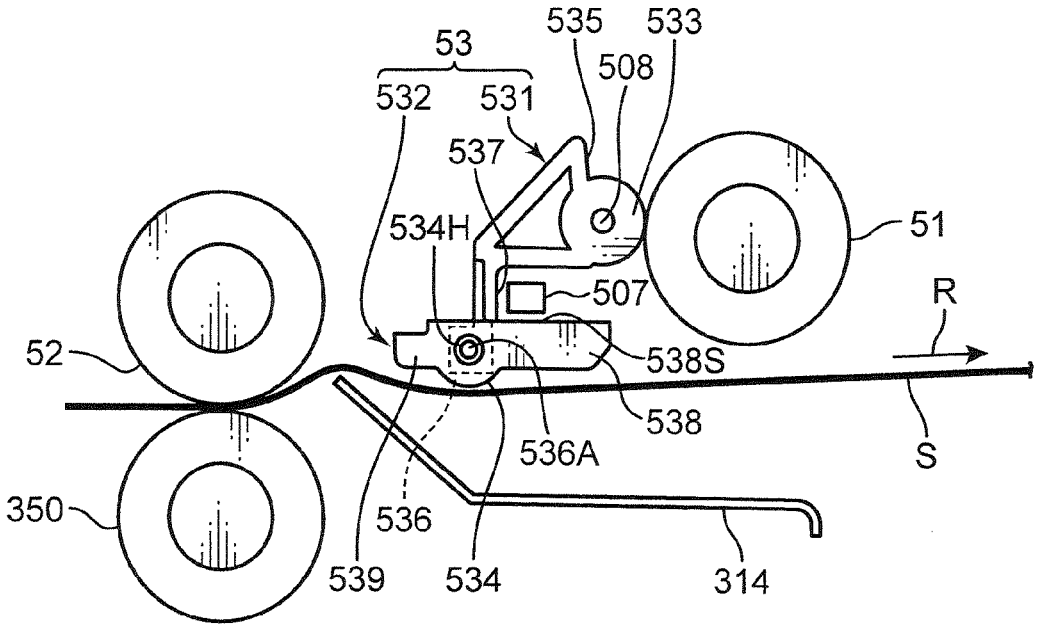
FIG. 10 is a diagram showing a state where the stopper member (stopper piece) is in a rotational posture.

The stopper piece 532 of the stopper mechanism 53 constructed as described above can change its posture among a restricting posture, a feed allowing posture and a rotational posture. FIG. 8 described above is a diagram showing a state where the stopper piece 532 is in the restricting posture, FIG. 9 is a diagram showing a state where the stopper piece 532 is in the feed allowing posture, and FIG. 10 is a diagram showing a state where the stopper piece 532 is in the rotational posture. The respective postures of the stopper piece 532 are described below with reference to FIGS. 8 to 10.

(Restricting Posture)

The stopper piece 532 assumes the restricting posture to restrict the position of a leading end SU of a document sheet S in the feeding direction. As shown in FIG. 8, the stopper piece 532 assumes the restricting posture when the pickup roller 51 is in a retracted posture in which it is spaced from the document sheet S by a pivoting movement of the holder 50. When the stopper piece 532 is in the restricting posture, the stopper piece 532 projects toward the downstream end 314 of the document feed tray 31 and the restricting surface 538S of the contact end portion 538 serves as a wall surface extending perpendicularly to the document sheet S placed on the document feed tray 31. This enables the restricting surface 538S of the contact end portion 538 to come into contact with the leading end SU of the document sheet S in the feeding direction. Thus, the position of the leading end SU of the document sheet S in the feeding direction is restricted and the leading end SU in the feeding direction is aligned. As a result, it is suppressed that the document sheet S is fed in an oblique posture by the pickup roller 51.

The restricting posture of the stopper piece 532 is maintained by a first contact piece 322 (first contact portion: see FIG. 4). The first contact piece 322 is formed on the ceiling plate 320 of the upper cover unit 32U. The holder 50 rests on the ceiling plate 320 when the pickup roller 51 is in the retracted posture. The position of the first contact piece 322 is so set that the first contact piece 322 can come into contact with the contact portion 535 of the supporting body 531 of the stopper mechanism 53 with the holder 50 resting on the ceiling plate 320.

If a user places a document sheet S on the document feed tray 31 to bring a leading end SU in the feeding direction into contact with the contact end portion 538 when the stopper piece 532 is in the restricting posture, a pressing force of the document sheet S acts on the contact end portion 538. The pressing force of the document sheet S acts to rotate the stopper piece 532 and consequently the supporting body 531 in the clockwise direction (first rotational direction) when viewed from front. However, since the first contact piece 322 comes into contact with the contact portion 535 of the supporting body 531 at this time, the clockwise rotation of the supporting body 531 is prevented. In this way, the restricting posture of the stopper piece 532 is maintained.

(Feed Allowing Posture)

The stopper piece 532 changes its posture from the restricting posture shown in FIG. 8 to the feed allowing posture when the pickup roller 51 assumes a feeding posture in which it is in contact with a document sheet S by a pivoting movement of the holder 50 as shown in FIG. 9. When the holder 50 pivots so that the pickup roller 51 assumes the feeding posture, i.e. when the right end of the holder 50 is lowered, the contact portion 535 of the supporting body 531 of the stopper mechanism 53 is separated from the first contact piece 322 of the ceiling plate 320. In this way, the clockwise rotation of the supporting body 531 is allowed. When the feed of the document sheet S is started by the rotation of the pickup roller 51, the stopper piece 532 is pushed up by the leading end SU of the document sheet S to be fed in the feeding direction to rotate clockwise and the contact end portion 538 is separated from the leading end SU in the feeding direction. In this way, restriction of the leading end SU in the feeding direction by the contact end portion 538 is released. The clockwise rotation of the stopper piece 532 is made possible by the supporting body 531 allowed to rotate clockwise. At this time, the contact end portion 538 is facing in a direction (first direction F) to convey the document sheet S from the pickup roller to the document feed roller 52 to such a degree as not to interfere with the feed of the document sheet S. When the document sheet S is conveyed, the contact end portion 538 is located in the sheet conveyance route and the document sheet S is conveyed while sliding in contact with the contact end portion 538.

The front plate 501 of the holder 50 is formed with a second contact piece 506 (second contact portion: see FIG. 5). The position of the second contact piece 506 on the front plate 501 is set to be near the supporting body 531 and closer to the pickup roller 51 than the supporting body 531 when viewed from front. Further, the second contact piece 506 extends in a vertical direction of the front plate 501. The height of the second contact piece 506 in the vertical direction is so set that the upper edge of the second contact piece 506 comes into contact with the contact portion 535 of the supporting body 531 if the supporting body 531 rotates clockwise beyond a predetermined rotation range when the stopper piece 532 is in the feed allowing posture.

Accordingly, when the stopper piece 532 is pushed up by the document sheet S and the supporting body 531 tries to rotate clockwise beyond the predetermined rotation range, the second contact piece 506 comes into contact with the contact portion 535 of the supporting body 531. Since this prevents the supporting body 531 from rotating more than necessary, the feed allowing posture of the stopper piece 532 is stabilized.

(Rotational Posture)

In this embodiment, the stopper piece 532 can further assume the rotational posture shown in FIG. 10 from the feed allowing posture shown in FIG. 9. The stopper piece 532 can assume the rotational posture when a document sheet S is jammed in the document conveying unit 32 (sheet conveyance route), while being in the feed allowing posture shown in FIG. 9.

In the automatic document feeder 3 of this embodiment, when the document sheet S is jammed, the jammed document sheet S can be removed by setting the upper cover unit 32U (see FIG. 4) in the open state and exposing the first and second conveyance paths 341, 342 to the outside.

However, if the user does not know about the procedure of the above jam process, he tries to grab a part (e.g. trailing end in the feeding direction) of the jammed document sheet and forcibly pull out the jammed sheet from the first conveyance path 341 or the second conveyance path 342 if the trailing end in the feeding direction remains on the document feed tray 31. By the user forcibly pulling out the document sheet S, the stopper piece 532 in the feed allowing posture may be caught by the document sheet S to tear the document sheet S.

The posture change of the stopper piece 532 from the feed allowing posture to the rotational posture in this embodiment solves the above problem. That is, if the document sheet S is jammed in a state where the pickup roller 51 is in the feeding posture and the stopper piece 532 is in the feed allowing posture as shown in FIG. 9, the user who does not know about the procedure of the above jam process tries to grab a part (trailing end part in the feeding direction) of the document sheet S remaining at the outer side of the pickup roller 51 and pull out the document sheet S in a direction (second direction R) opposite to the first direction F. The pickup roller 51 is subjected to an upward acting pressing force from the document sheet S due to the operation of pulling out the document sheet S in the second direction R. If this pressing force is transmitted to the holder 50 via the pickup roller 51, the holder 50 starts pivoting and the pickup roller 51 starts moving upward. That is, the pickup roller 51 starts assuming the retracted posture.

At this time, since the contact end portion 538 of the stopper piece 532 held in contact with the jammed document sheet S is facing in the first direction F, a tensile force to move the contact end portion 538 in the second direction R acts on the contact end portion 538 of the stopper piece 532 by the operation of pulling out the document sheet S in the second direction R. By this tensile force, a force to rotate the stopper piece 532 counterclockwise acts on the stopper piece 532. The stopper piece 532 is free to rotate about the first rotational pivot point as described above. Thus, if a tensile force acts on the contact end portion 538 of the stopper piece 532, the stopper piece 532 rotates counterclockwise about the first rotational pivot point and the contact end portion 538 faces in the second direction R as shown in FIG. 10. In this way, the stopper piece 532 assumes the rotational posture. The rotation range of the contact end portion 538 is so set that the contact end portion 538 faces in the second direction R. With the contact end portion 538 facing in the second direction R, the stopper piece 532 extends substantially in parallel with the document sheet S and the surface of the stopper piece 532 opposite to the restricting surface 538S is in contact with one side of the document sheet S. Therefore, a pressure (tensile force) received by the stopper piece 532 from the document sheet S being pulled out is reduced. In this way, breakage of the document sheet S is suppressed.

Note that the supporting body 531 rotatably supporting the stopper piece 532 about the first rotational pivot point also rotates counterclockwise (second rotational direction opposite to the first rotational direction) as the stopper piece 532 rotates (as the posture is changed to the rotational posture). Specifically, when a tensile force acts on the contact end portion 538 of the stopper piece 532, this tensile force is transmitted to the supporting body 531 via the stopper piece 532. The supporting body 531 is free to rotate about the second rotational pivot point as described above. Thus, when the tensile force is transmitted to the supporting body 531, the supporting body 531 rotates counterclockwise as shown in FIG. 10 from the state of FIG. 9. By the counterclockwise rotation of the supporting body 531, the pressure of the document sheet S being pulled out is let to successively escape to the stopper piece 532 and the supporting body 531. In this way, the posture of the stopper piece 532 is smoothly changed to the rotational posture.

The rotational posture of the stopper piece 532 is maintained by a third contact piece 507 (third contact portion: see FIG. 5). The third contact piece 507 is formed on the front plate 501 of the holder 50. The third contact piece 507 is formed at a position immediately below the bottom side of the supporting body 531 and immediately to the right of the rotation preventing piece 537 of the supporting body 531. That is, the third contact portion 507 is formed at the position to be able to come into contact with the rotation preventing piece 537 when the stopper piece 532 is in the restricting posture. When the supporting body 531 rotates counterclockwise as the posture of the stopper piece 532 is changed to the rotational posture, the third contact piece 507 comes into contact with the rotation preventing piece 537. This prevents the rotation of the supporting body 531 and maintains the rotational posture of the stopper piece 532. In this way, the sheet is smoothly pulled out from the feeding mechanism.

According to the automatic document feeder 3 of this embodiment described above, the stopper piece 532 is supported on the supporting body 531 rotatably about the first rotational pivot point and the supporting body 531 is supported on the holder 50 rotatably about the second rotational pivot point. That is, in this embodiment, the stopper for restricting the position of the leading end SU of the document sheet S in the feeding direction has a divided construction. Since the stopper piece 532 rotates about the first rotational pivot point to assume the rotational posture when a jam occurs and a document sheet S is pulled out in the second direction R, a pressure (tensile force) received by the stopper piece 532 from the document sheet S being pulled out is reduced. As a result, breakage of the document sheet S is suppressed. In addition, since the supporting body 531 rotates counterclockwise (second rotational direction) as the posture of the stopper piece 532 is changed to the rotational posture, the pressure of the document sheet S being pulled out is let to successively escape to the stopper piece 532 and the supporting body 531. In this way, the posture of the stopper piece 532 is smoothly changed to the rotational posture.

Further, according to the automatic document feeder 3 of this embodiment, the pickup roller 51 assumes the retracted posture to be separated from the document sheet S at a timing when the supporting body 531 rotates counterclockwise and the stopper piece 532 assumes the rotational posture. Thus, the jammed document sheet S is smoothly pulled out from the sheet conveyance route. In this way, it is further suppressed that the document sheet S is caught by the stopper piece 532.

Furthermore, according to the automatic document feeder 3 of this embodiment, the posture change of the stopper piece 532 and that of the pickup roller 51 can be easily synchronized since the supporting body 531 is so supported on the shaft portion 508 of the holder 50 as to be rotatable about the second rotational pivot point.

Further, according to the automatic document feeder 3 of this embodiment, the first to third contact pieces 322 to 507 are provided to maintain the postures of the stopper piece 532. Since the first contact piece 322 maintains the restricting posture of the stopper piece 532, the position of the leading end SU of the document sheet S in the feeding direction is appropriately restricted before the feeding operation by the pickup roller 51. Further, since the second contact piece 506 prevents the supporting body 531 from rotating in the first rotational direction beyond the predetermined rotation range, the feed allowing posture of the stopper piece 532 is stabilized. Further, since the third contact piece 507 maintains the rotational posture of the stopper piece 532, the document sheet S is smoothly pulled out from the sheet conveyance route.

Since the image forming apparatus according to the present disclosure uses the sheet feeder capable of suppressing breakage of sheets, the image forming operation can be smoothly performed.

Although the sheet feeder as one aspect of the present disclosure has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeder, comprising:

a feeding mechanism for feeding a sheet along a sheet feeding route;

a supporting body;

a stopper member located in the sheet feeding route and rotatably supported about a first rotational pivot point on the supporting body; and a holder for rotatably supporting the supporting body for rotation about a second rotational pivot point;

wherein:

the stopper member includes a contact end portion; and the stopper member changes its posture among:

(i) a restricting posture in which the contact end portion comes into contact with a leading end of the sheet in a feeding direction to restrict the position of the leading end in the feeding direction before a feeding operation of feeding the sheet by the feeding mechanism;

(ii) a feed allowing posture which is assumed during the feeding operation and in which the contact end portion is separated from the position of the leading end of the sheet in the feeding direction in the restricting posture in a first direction in which the sheet is fed; and (iii) a rotational posture reached from the feed allowing posture by rotation of the stopper member about the first rotational pivot point so that the contact end portion faces in a second direction opposite to the first direction;

the second direction being a direction in which the sheet is pulled out from the feeding mechanism when a jam occurs in the feeding mechanism, wherein the supporting body:

has a rotational preventing piece to prevent the stopper member from rotating in a first rotational direction about the first rotational pivot point, rotates in the first rotational direction about the second rotational pivot point as the posture of the stopper member is changed from the restricting posture to the feed allowing posture due to the rotation preventing piece preventing the rotation of the stopper member in the first rotational direction about the first rotational pivot point, and rotates in a second rotational direction opposite to the first rotational direction about the second rotational pivot point as the posture of the stopper member is changed from the feed allowing posture to the rotational posture due to the stopper member rotating in the second rotational direction about the first rotational pivot point;

wherein, the holder further includes a third contact portion which comes into contact with the supporting body to prevent the rotation of the supporting body in the second rotational direction about the second rotational pivot point; and the third contact portion comes into contact with the supporting body when the stopper member is in the rotational posture.

2. A sheet feeder according to claim 1, wherein:

the feeding mechanism includes:

the holder, a roller member rotatably held by the holder and adapted to feed the sheet by the rotation thereof, and a pivoting unit for pivoting the holder;

the pivoting unit changes the posture of the roller member between a feeding posture in which the roller member is in contact with the sheet to start feeding the sheet and a retracted posture in which the roller member is separated from the sheet by pivoting the holder;

the stopper member assumes the restricting posture when the roller member is in the retracted posture while assuming the feed allowing posture when the roller member is in the feeding posture; and the roller member assumes the retracted posture at a timing when the supporting body rotates in the second rotational direction and the stopper member assumes the rotational posture.

3. A sheet feeder according to claim 2, wherein:

the holder includes a shaft portion; and the supporting body is so supported on the shaft portion as to be rotatable about the second rotational pivot point.

4. A sheet feeder according to claim 2, further comprising a housing for housing the feeding mechanism, the stopper member and the supporting body, wherein:

the housing includes a first contact portion which comes into contact with the supporting body to prevent the rotation of the supporting body in the first rotational direction; and the first contact portion comes into contact with the supporting body when the stopper member is in the restricting posture.

5. A sheet feeder according to claim 2, wherein the holder includes a second contact portion which comes into contact with the supporting body when the supporting body rotates in the first rotational direction beyond a predetermined rotation range when the stopper member is in the feed allowing posture.

6. A sheet feeder according to claim 2, further comprising a housing for housing the feeding mechanism, the stopper member and the supporting body, wherein:

the housing includes a first contact portion which comes into contact with the supporting body to prevent the rotation of the supporting body in the first rotational direction;

the first contact portion comes into contact with the supporting body when the stopper member is in the restricting posture; and the holder includes a second contact portion which comes into contact with the supporting body when the supporting body rotates in the first rotational direction beyond a predetermined rotation range when the stopper member is in the feed allowing posture.

7. An image forming apparatus, comprising:

a sheet feeder including a conveyance path for conveying a document sheet and a reading position where a document image of the document sheet is read, and adapted to convey the document sheet to the reading position;

a reader for reading the document image at the reading position to obtain image data; and an image forming unit for forming an image based on the image data on a recording sheet;

wherein a sheet feeder according to claim 1 is used as the sheet feeder.

* * * * *